US005448223A

United States Patent [19]

Johnson

[11] Patent Number: 5,448,223

[45] Date of Patent: Sep. 5, 1995

[54] CURRENCY ALARM PACK HAVING RECEIVER AUTOMATIC GAIN HYSTERESIS

[75] Inventor: Raymond C. Johnson, Bonaire, Ga.

[73] Assignee: ICI Americas, Inc., Wilmington, Del.

[21] Appl. No.: 314,419

[22] Filed: Sep. 28, 1994

[51] Int. Cl.[6] ..... G08B 13/181

[52] U.S. Cl. ..... 340/571; 109/29; 109/31; 109/32; 109/38; 340/522

[58] Field of Search ..... 340/571, 522; 109/32, 109/31, 29, 38

[56] References Cited

U.S. PATENT DOCUMENTS

| | | | |
|---|---|---|---|
| 2,041,577 | 5/1936 | Sutherland | 340/571 |
| 3,564,525 | 2/1971 | Robeson et al. | 340/571 |
| 3,633,194 | 1/1972 | Kothe | 340/568 |
| 3,685,037 | 8/1972 | Bennett et al. | 340/568 |
| 3,750,583 | 8/1973 | White et al. | 102/216 |
| 3,781,860 | 12/1973 | Freyling, Jr. | 340/571 |
| 3,828,341 | 8/1974 | Carter, Jr. et al. | 340/571 |
| 3,836,901 | 9/1974 | Matto et al. | 340/568 |
| 4,267,553 | 5/1981 | Vogelsanger et al. | 340/571 |
| 4,327,360 | 4/1982 | Brown | 340/571 |
| 4,511,888 | 4/1985 | Bernhardt | 340/571 |
| 4,559,529 | 12/1985 | Bernhardt | 340/571 |
| 4,573,043 | 2/1986 | Heuker of Hoek et al. | 340/571 |
| 4,639,716 | 1/1987 | Payne | 340/571 |
| 4,686,514 | 8/1987 | Liptak, Jr. et al. | 340/571 |
| 4,833,456 | 5/1989 | Heller | 340/571 |
| 4,908,606 | 3/1990 | Kevonian | 340/571 |
| 4,908,608 | 3/1990 | Reinke et al. | 340/571 |
| 4,975,680 | 12/1990 | Fogle, Jr. | 340/571 |
| 4,985,695 | 1/1991 | Wilkinson et al. | 340/571 |
| 5,059,949 | 10/1991 | Caparoni et al. | 340/571 |
| 5,091,713 | 2/1992 | Horne et al. | 340/541 |
| 5,130,695 | 7/1992 | Scarbrough et al. | 340/527 |
| 5,196,828 | 3/1993 | Keniston | 340/571 |

FOREIGN PATENT DOCUMENTS 9302435 2/1993 WIPO .

*Primary Examiner*—Glen Swann

*Attorney, Agent, or Firm*—Howson & Howson

[57] ABSTRACT

A currency alarm pack for triggering an alarm to foil a bank robbery consists of a receiver for detecting an electromagnetic field at the exit of a bank and a circuit which activates an alarm to release dye and/or tear gas when the alarm pack leaves the field. The receiver has automatic gain control hysteresis causing its gain to increase when it first detects the field so that it automatically locks onto the field. This reduces the chance of activation of the alarm pack inside a bank if the robber does not exit the bank immediately.

11 Claims, 1 Drawing Sheet

CURRENCY ALARM PACK HAVING RECEIVER AUTOMATIC GAIN HYSTERESIS

BRIEF SUMMARY OF THE INVENTION

This invention relates generally to anti-theft devices and more particularly to an alarm device adapted to be concealed in or among articles likely to be stolen, for example, packs of currency handled by bank tellers.

Currency alarm packs have the appearance of ordinary currency, but include concealed alarm devices which explosively release dye or produce other audible or visible alarms to facilitate detection of theft and apprehension of the perpetrator. In the case of a bank robbery, for example, the teller may include an alarm pack among packs of currency delivered to the robber. A timer in the alarm pack triggers a squib at the end of a predetermined delay, causing the release of dye and tear gas which makes the stolen currency identifiable and temporarily disables the robber.

One form of currency alarm pack for thwarting bank robbers is described in U.S. Pat. No. 3,828,341, issued on Aug. 6, 1974 to C. H. Carter and S. M. Newfeld. The timer in the alarm pack of the Carter and Newfeld patent is activated by a localized electromagnetic field generated adjacent to the exit of a bank. For the alarm to be triggered, the alarm pack must first be taken into the field and then moved out of the field. When the alarm pack is moved out of the field, the timer is activated. Then, at the end of a timing interval, the alarm is triggered. Provision is made in the alarm circuitry to reset the timer, and thereby prevent triggering of the alarm, if the robber returns to the field before the timer triggers the alarm.

A drawback with the currency alarm packs known in the art is the potential for the squib to fire and release tear gas and dye inside the confines of a bank. A prematurely fired alarm pack may not only thwart the purpose of the alarm pack, but may also cause the robber to become more violent, thereby placing the people in the bank at the time of the robbery in greater danger.

Unintended triggering within the bank can take place under the following sequence of events. A robber, remaining within the bank after having been given a currency alarm pack, may move around within the bank near and away from the exit, where the exit field transmitter is located. As the robber moves around inside the bank, the alarm pack may become activated by the signal from the transmitter. Because the field is not uniformly strong within the interior of the bank, further movement may cause the alarm pack to lose the field and subsequently fire after a predetermined time delay. It is not a practical solution to increase the power of the transmitted signal to cover the entire interior of the bank, because the purpose of the system is to activate the alarm pack only when the robber passes through the exit, and not to activate the pack when it is located elsewhere in the bank remote from the exit.

The principal object of this invention, therefore, is to provide a currency alarm pack which incorporates desirable features for theft detection, but which possesses a high degree of immunity to unintended triggering. It is also an object of the invention to provide an alarm pack which can be moved around within the confines of a building without firing prematurely.

The foregoing objects are achieved in accordance with the invention by providing, in the alarm pack, an improved receiver which locks onto the field.

A preferred currency alarm pack in accordance with the invention comprises a package simulating the appearance of a pack of currency. Hidden within the package is a receiver responsive to a field, e.g. an electromagnetic exit field. The package also includes a detector responsive to the output of the receiver for detecting the field, and a device, such as a pyrotechnic squib, for producing an alarm after being triggered. A logic device responsive to the detector, triggers the alarm if a field is detected and thereafter the amplitude of the field at the receiver decreases. The invention provides hysteresis in the operation of the receiver, detector and logic device, so that the alarm is triggered only when the amplitude of the field at the receiver falls to a triggering level substantially below the level at which the detector first detects the field. Preferably, the desired hysteresis is achieved by increasing the sensitivity of the receiver when the field is first detected.

The exit field generator adjacent to the exit of a bank enclosure preferably produces a field having an amplitude which exceeds the triggering level only in the immediate vicinity of the exit. Elsewhere on the banking floor, the field amplitude is below the triggering level. This is desirable in order to avoid excessively high fields, which can arm the alarm packs prematurely, and expose workers unnecessarily to the field over long periods of time. However, the low field level also gives rise to a risk of triggering inside the bank in case the robber approaches the exit and retreats toward another part of the interior of the bank. The acquisition and subsequent loss of the field by the alarm pack will initiate the triggering sequence. The hysteresis in the receiver sensitivity avoids this risk by causing the alarm pack effectively to "lock onto" the field signal. Therefore, a robber can move about in the bank enclosure with the alarm pack in hand, without causing the alarm to be triggered within the enclosure. Specifically, if in the course of a robbery, the currency alarm pack is given to a robber inside a bank, and the robber approaches the bank exit, the alarm pack will detect the exit field. When this happens, the gain of the receiver in the alarm pack is immediately increased and held at the increased level, so that, if the robber moves within the bank away from the exit, and therefore the received field strength decreases, the field will still be detected and the alarm will be prevented from firing.

Further objects, details and advantages of the invention will be apparent from the following detailed description, when read in conjunction with the drawings.

DETAILED DESCRIPTION

Figure 1:
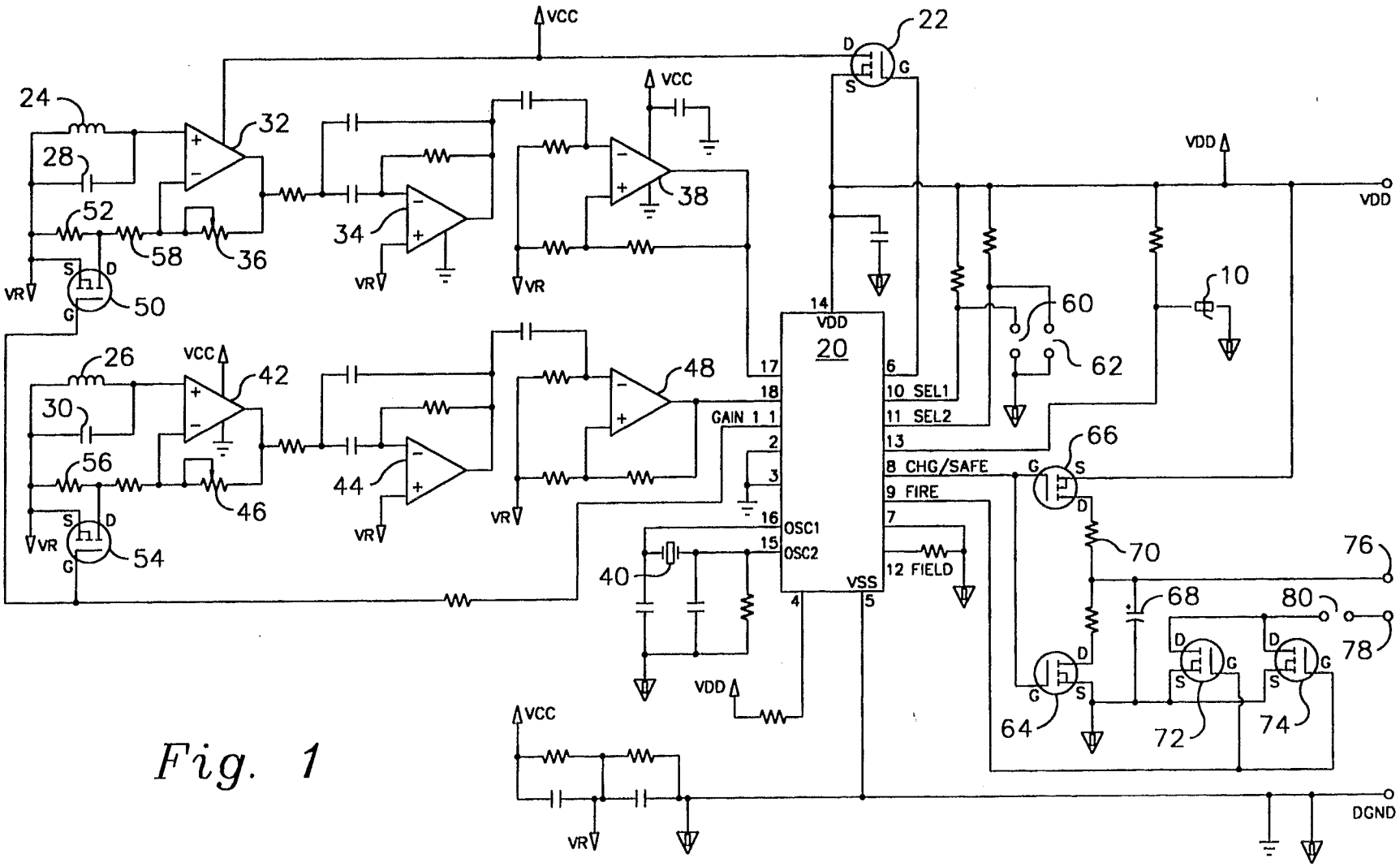
FIG. 1 is a schematic diagram showing the logic circuit of a preferred form of alarm pack in accordance with the invention.

The components within an alarm pack generally include a receiver, a triggerable alarm and a logic device. The receiver responds to a field which is transmitted by an antenna or magnetic loop near an exit of a bank. The logic device responds to the signals detected by the receiver means and triggers a triggerable alarm which fires a squib to release dye, tear gas, or both, or which produces some other kind of alarm.

Normally, the alarm pack is disabled when it is on a magnetic baseplate located near a bank teller. Disabling of the alarm pack is accomplished by a magnetic reed switch (not shown), as discussed in U.S. Pat. No. 3,828,341. In addition, as shown in FIG. 1, a mercury tilt switch 10 is provided in the logic circuit to detect motion. If no motion is detected, or the alarm pack is located on the magnetic baseplate, the circuit is placed in a sleep state to conserve battery power.

The logical operations are carried out by a microprocessor 20. When no motion has been detected for given time, the microprocessor 20 sends a signal to the gate of an insulated gate field effect transmitter (IGFET) 22, which switches off the power to the various components of the circuit. Microprocessor 20 is preferably a MicroChip Technology PIC16C71 microprocessor having 1K of program memory.

When motion is detected, the circuit is switched to its full power mode by IGFET 22, and the receiver is enabled. The receiver comprises two identical antenna coils 24 and 26 shunted respectively by identical capacitors 28 and 30. The specific frequency to which the receiver is tuned is determined by inductance of coils 24 and 26 and the capacitance of capacitors 28 and 30. The antennae are arranged for sensing fields polarized in mutually orthogonal planes.

The signals received by the antenna coil 24 are amplified by operational amplifiers 32 and 34. Similarly, the signals received by the antenna coil 26 are amplified by operational amplifiers 42 and 44. Variable resistors 36 and 46 are provided for adjustment of the gain of the amplifiers. The amplified signals are then sent to comparators 38 and 48, which convert the received signals to digital pulses. The digital pulses are then passes to the microprocessor 20. Comparators 38 and 48 serve as zero crossing detectors which change state from "zero" to "one" each time their sinusoidal inputs cross the zero. The resultant outputs of the comparators are streams of digital pulses synchronized with the received signal.

The microprocessor 20 checks the received signals for proper frequency and stability. Microprocessor 20 identifies the exit field by using digital processing techniques to determine whether or not the incoming signal is within acceptable limits. Microprocessor 20 counts the digital pulses produced at the outputs of comparators 38 and 48 for a specified time period established by a clock crystal 40. The count must fall within preset limits to be acceptable, and typically three sequential acceptable counts must be obtained before the signal is determined to correspond to a valid exit field. Changes in pulse width, frequency, pulse to pulse jitter, pulse stability, or noise causes the pulse count to be incorrect, and labeled as invalid.

When a signal is acquired from a transmitted field located at a bank exit door, the receiver locks onto the acquired signal. The microprocessor 20 determines whether or not the received signal corresponds to a valid exit field. When microprocessor 20 detects a signal corresponding to a valid exit field, the "GAIN" output of microprocessor 20 goes to a high state, causing IGFETs 50 and 54 to short circuit resistors 52 and 56 respectively. This increases the gain of amplifiers 32 and 42. The increase in the gain of the two amplifiers causes the receiver to lock onto the signal.

The gain of the first stage of each receiver is determined by the relative amount of feedback applied to the negative input of the first stage operational amplifier.

When the IGFET 50 is in cut-off, the gain of operational amplifier 32 is approximately proportional to:

$$\frac{R_1}{R_2 + R_3}$$

Where $R_1$ is the resistance of resistor 36, $R_2$ is the resistance of resistor 52, and $R_3$ is the resistance of resistor 58.

Short-circuiting of resistor 52 causes the amplifier gain to increase to:

$$R_1/R_3$$

The gain of amplifier 42 is similarly affected by the short-circuiting of resistor 56 by IGFET 54.

After the alarm pack acquires the exit field, the time interval for firing the squib does not begin to run until after the receiver loses the field. Microprocessor 20 remains in a "hold" state as long as the signal is received. Because the receiver gain has been increased, microprocessor 20 will switch out of its hold state only if the receiver signal falls to a new limit much lower than the level at which the signal was first detected. A dip in the receive signal level below this new, lower level indicates that the alarm pack has moved a significant distance away from the bank exit. Thus, the bank robber can move around inside the bank, and the increased level of gain of the receiver will prevent an unintended triggering. The transmitted signal will only be lost when the robber is outside the bank and at a significant distance.

When the transmitted field received by the receiver means falls below a predetermined second amplitude, which is lower than the first amplitude, the logic circuit triggers the alarm means. Microprocessor 20 immediately begins counting down a predetermined delay time. The delayed time can be set by jumpers at terminals 60 and 62 to 5, 10, 20 or 40 seconds. If the receiver again detects the transmitted field, the timer is reset and will not begin timing down again until the alarm pack leaves the field.

Activation of the squib occurs after the preset countdown time has elapsed. One second prior to the elapsed delay, the "CHG/SAFE" output of microprocessor 20 goes to a low state which cuts off transistor 64 and switches transistor 66 into conduction, to charge capacitor 68 through resistor 70. Upon completion of the delay countdown, the "FIRE" of output microprocessor 20 goes to a high state, enabling parallel transistors 72 and 74, to apply current to fire the squib connected to terminals 76 and 78. A shunt across terminal 80 can be removed to disable the squib during testing.

From the foregoing, it should now be apparent that an alarm pack can be prevented from triggering inside the confines of a bank during a bank robbery regardless of the movement of the bank robber. It is the gain hysteresis feature which allows the alarm pack to increase its sensitivity once an initial signal is received. The increased gain of the receiver allows the alarm pack to receive the signal anywhere throughout the confines of the bank, thereby preventing unintended triggering.

Many modifications can be made to the apparatus described. For example, while the authenticity of the exit field is preferably verified by counting pulses repeatedly, the exit field can be authenticated in various other ways, such as by decoding an encoded field signal. Amplitude discrimination is, of course, inherent in the operation of the combination of amplifiers, comparators and microprocessor. However, specific circuitry designed to respond to field intensities in excess of a given level and to ignore lower field intensities can also be used. Other schemes can be used to alter the gain of the amplifiers. While a specific microprocessor has been disclosed, other microprocessor chips known in the art can be used. Discrete or programmed array logic also can be used. Many other modifications will occur to persons skilled in the art and can be made without departing from the scope of the invention as defined in the following claims.

I claim:

1. A currency alarm comprising a package simulating the appearance of a pack of currency, said package having, hidden within it, receiver means responsive to a field and producing an output, detection means, responsive to the output of said receiver means, for detecting a field, alarm means for producing an alarm when triggered, means responsive to said detection means for triggering said alarm means if a field is detected by said detection means and thereafter the amplitude of the field at the receiver means decreases to a level substantially below the level at which the detection means first detects the field.

2. A currency alarm pack according to claim 1 in combination with a bank defined by an enclosure having an exit and an exit field generating means adjacent to said exit, wherein the exit field generating means produces a field having an amplitude, throughout a substantial portion of said enclosure, below the level at which the detection means first detects the field.

3. A currency alarm pack according to claim 1 in which said detection means comprises means for converting said output of the receiver means to digital pulses and for counting the number of said pulses which occur in a predetermined interval.

4. A currency alarm pack according to claim 1 in which said detection means comprises a microprocessor.

5. A currency alarm pack according to claim 1 in which said receiver means comprises redundant receivers.

6. A currency alarm comprising a package simulating the appearance of a pack of currency, said package having, hidden within it, receiver means responsive to a field and producing an output, detection means, responsive to the output of said receiver means, for detecting a field, alarm means for producing an alarm after being triggered, means responsive to said detection means for triggering said alarm means if a field is detected and thereafter the amplitude of the field at the receiver means decreases, and means for increasing the sensitivity of said receiver means when the field is detected by said detecting means, whereby the alarm means is triggered only when the amplitude of the field at the receiver means falls to a triggering level substantially below the level at which the detection means first detects the field.

7. A currency alarm according to claim 6 in combination with a bank defined by an enclosure having an exit and an exit field generating means adjacent to said exit, wherein the exit field generating means produces a field having an amplitude, throughout a substantial portion of said enclosure, which is below said triggering level.

8. A currency alarm pack according to claim 6 in which said detection means comprises means for converting said output of the receiver means to digital pulses and for counting the number of said pulses which occur in a predetermined interval.

9. A currency alarm pack according to claim 6 in which said detection means comprises a microprocessor.

10. A currency alarm pack according to claim 6 in which said receiver means comprises redundant receivers.

11. A currency alarm pack according to claim 6 in which said receiver means comprises an amplifier having a feedback loop, including a resistor, and in which said means for increasing the sensitivity of said receiver comprises switching means for short-circuiting said resistor.

* * * * *